US008857412B2

(12) United States Patent
Nistler et al.

(10) Patent No.: US 8,857,412 B2
(45) Date of Patent: Oct. 14, 2014

(54) METHODS AND SYSTEMS FOR COMMON RAIL FUEL SYSTEM DYNAMIC HEALTH ASSESSMENT

(75) Inventors: Paul Gerard Nistler, Lawrence Park, PA (US); Nikita Goel, San Mateo, CA (US)

(73) Assignee: General Electric Company, Schenectady, NY (US)

( * ) Notice: Subject to any disclaimer, the term of this patent is extended or adjusted under 35 U.S.C. 154(b) by 583 days.

(21) Appl. No.: 13/177,139

(22) Filed: Jul. 6, 2011

(65) Prior Publication Data

US 2013/0013175 A1 Jan. 10, 2013

(51) Int. Cl.

| | |
|---|---|
| ***F02M 69/46*** | (2006.01) |
| ***F02D 41/38*** | (2006.01) |
| ***F02D 41/24*** | (2006.01) |
| ***F02M 37/00*** | (2006.01) |
| *F02D 41/20* | (2006.01) |
| *F02D 41/22* | (2006.01) |

(52) U.S. Cl.

CPC .... *F02D 41/3845* (2013.01); *F02D 2041/2058* (2013.01); *F02D 2200/063* (2013.01); *F02D 2041/224* (2013.01); *F02D 41/22* (2013.01); *F02D 2200/0602* (2013.01); *F02D 41/2464* (2013.01); *F02D 2041/225* (2013.01); *F02M 37/0047* (2013.01)

USPC ..... 123/446; 123/198 D; 123/198 DB; 701/103; 701/107; 701/112

(58) Field of Classification Search

CPC . F02M 59/366; F02M 59/367; F02M 59/368; F02M 59/44; F02M 59/464; F02M 59/466; F02M 63/024; F02M 63/0225; F02D 41/3836; F02D 41/3845; F02D 41/3854; F02D 2250/31; F02D 2200/06; F02D 41/22; F02D 41/221; F02D 41/222; F02D 17/04; F02D 41/042

USPC ..... 123/446, 447, 458, 198 D, 198 DB; 701/103–107, 112, 114; 73/114.38, 73/114.41, 114.43

See application file for complete search history.

(56) References Cited

U.S. PATENT DOCUMENTS 5,197,508 A * 3/1993 Gottling et al. ..... 137/1
5,685,268 A 11/1997 Wakemen (Continued)

FOREIGN PATENT DOCUMENTS

DE 19802583 A1 8/1999
WO 2005068810 A1 7/2005

OTHER PUBLICATIONS

Search Report and Written Opinion from corresponding PCT Application No. PCT/US2012/040648 dated Feb. 25, 2013.

*Primary Examiner* — Thomas Moulis

(74) *Attorney, Agent, or Firm* — GE Global Patent Operation; John A. Kramer

(57) ABSTRACT

Fuel control dynamic health assessment systems and methods related to monitoring fuel flow control are provided. In one embodiment, a method for controlling a system having an engine, includes determining a predicted valve position of a valve, the valve being operable to control fuel flow to a fuel pump that pumps fuel to a common fuel rail of the engine, determining an actual valve position, determining an error between the predicted valve position and the actual valve position, and setting a degradation condition in response to the error.

20 Claims, 5 Drawing Sheets

(56) References Cited

U.S. PATENT DOCUMENTS

| | | | | |
|---|---|---|---|---|
| 6,119,655 | A | 9/2000 | Heinitz et al. | |
| 6,390,068 | B1 * | 5/2002 | Hartke et al. | 123/479 |
| 6,557,530 | B1 | 5/2003 | Benson et al. | |
| 6,732,714 | B2 * | 5/2004 | Frenz et al. | 123/479 |
| 6,964,262 | B2 * | 11/2005 | Hayakawa | 123/458 |
| 7,111,605 | B2 | 9/2006 | Bale et al. | |
| 7,171,952 | B2 * | 2/2007 | Joos et al. | 123/457 |
| 7,195,001 | B1 | 3/2007 | Pallett | |
| 7,201,150 | B2 * | 4/2007 | Oono | 123/506 |
| 7,240,667 | B2 * | 7/2007 | Dolker | 123/456 |
| 7,293,548 | B2 * | 11/2007 | Oono | 123/446 |
| 7,337,652 | B2 | 3/2008 | Shamine | |
| 7,347,188 | B2 * | 3/2008 | Ohshima | 123/458 |
| 7,370,635 | B2 * | 5/2008 | Snopko et al. | 123/446 |
| 7,389,767 | B2 * | 6/2008 | Kasbauer et al. | 123/457 |
| 7,392,790 | B2 * | 7/2008 | Shafer et al. | 123/446 |
| 7,431,018 | B2 * | 10/2008 | Tsujimoto | 123/446 |
| 7,438,052 | B2 * | 10/2008 | Awano et al. | 123/456 |
| 7,503,313 | B2 * | 3/2009 | Achleitner et al. | 123/446 |
| 7,543,566 | B2 | 6/2009 | Holl et al. | |
| 7,552,704 | B2 * | 6/2009 | Gaessler et al. | 123/90.12 |
| 7,596,447 | B2 * | 9/2009 | Oono | 701/114 |
| 7,606,656 | B2 * | 10/2009 | Dolker | 701/113 |
| 7,933,688 | B2 * | 4/2011 | LaPlante et al. | 700/281 |
| 8,108,124 | B2 * | 1/2012 | Jung et al. | 701/104 |
| 8,539,934 | B2 * | 9/2013 | Kaneko | 123/458 |
| 2003/0154956 | A1 | 8/2003 | Eckerle et al. | |
| 2006/0130813 | A1 | 6/2006 | Dolker | |
| 2008/0319630 | A1 * | 12/2008 | Aguinaga et al. | 701/101 |
| 2011/0295493 | A1 * | 12/2011 | Wilms et al. | 701/103 |

* cited by examiner

METHODS AND SYSTEMS FOR COMMON RAIL FUEL SYSTEM DYNAMIC HEALTH ASSESSMENT

FIELD

The subject matter disclosed herein relates to methods and systems for controlling a common rail fuel system in a vehicle.

BACKGROUND

Vehicles, such as rail vehicles, include power sources, such as diesel engines. In some vehicles, fuel is provided to the diesel engine by a common rail fuel system. One type of common rail fuel system comprises a low-pressure fuel pump in fluid communication with a high-pressure fuel pump, and a fuel rail in fluid communication with the high-pressure fuel pump and further in fluid communication with at least one engine cylinder. The high-pressure fuel pump pressurizes fuel for delivery through the fuel rail. Fuel travels through the fuel rail to at least one fuel injector, and ultimately to at least one engine cylinder where fuel is combusted to provide power to the vehicle. In order to reduce the likelihood of engine degradation, the common rail fuel system may be monitored for fuel leaks.

In one approach, the common rail fuel system detects fuel leaks by positioning a liquid sensor in an exterior wall of a double-walled conduit. If a crack occurs in an inner wall of the double-walled conduit, fuel enters a cavity between the inner wall and the outer wall through the crack. Fuel fills the cavity until it is detected by the liquid sensor, at which point a fault is triggered that indicates a fuel leak.

However, the inventors herein have identified issues with the above described approach. For example, the addition of the liquid sensor to detect fuel leaks increases production costs and design complexity of the fuel system. As another example, the above approach is merely capable of detecting fuel leaks in the double-walled conduit. If a fuel leak occurred elsewhere in the common rail fuel system, such as through a fuel injector nozzle or a fuel injector control path, it may not be detected by the liquid sensor.

BRIEF DESCRIPTION OF THE INVENTION

In one embodiment, a method for controlling a system having an engine includes determining a predicted valve position of a valve, the valve being operable to control fuel flow to a fuel pump that pumps fuel to a common fuel rail of the engine, determining an actual valve position, determining an error between the predicted valve position and the actual valve position, and setting a degradation condition in response to the error.

In one example, the predicted inlet metering valve position is derived from a current of the inlet metering valve. The inlet meter valve current may be derived from a steady-state fuel flow balance on the common rail fuel system that correlates fuel flow into and out of the common rail fuel system. Disparities in the predicted current versus actual current indicate that a fuel flow unaccounted for in the flow balance model may exist, such as due to a leak. Alternatively, disparities between predicted and actual current can indicate that a component has failed (e.g., a high pressure fuel pump (HPP) has excessive wear). By using the inlet metering valve current to predict operation of the common rail fuel system, fuel leaks may be detected from available engine operating data without, or in addition to, specialized sensors coupled in double wall fuel lines Also, such an approach can be more easily adaptable for different engines and different fuel systems since.

This brief description is provided to introduce a selection of concepts in a simplified form that are further described herein. This brief description is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure. Also, the inventors herein have recognized any identified issues and corresponding solutions.

BRIEF DESCRIPTION OF THE DRAWINGS

The present invention will be better understood from reading the following description of non-limiting embodiments, with reference to the attached drawings, wherein below.

DETAILED DESCRIPTION

The present description relates to vehicles, such as rail vehicles, that include an engine (such as a diesel engine) where fuel is provided to the engine through a common rail fuel system (CRS). The CRS includes a common fuel rail that provides fuel to a plurality of fuel injectors for fuel injection into cylinders of the engine. In one example, the CRS includes an inlet metering valve (IMV) that is positioned between a low-pressure fuel pump and a high-pressure fuel pump. The IMV is operable to control fuel flow to the high-pressure fuel pump that supplies the common fuel rail with fuel. The IMV can be adjusted to vary an amount of fuel provided to the common fuel rail as operation conditions change. More particularly, the present description is related to dynamically assessing the health of the CRS.

For example, the health of the CRS can be dynamically assessed through various approaches for detecting fuel leaks in the CRS. One embodiment of a CRS is shown in FIG. 1.

Figure 1:
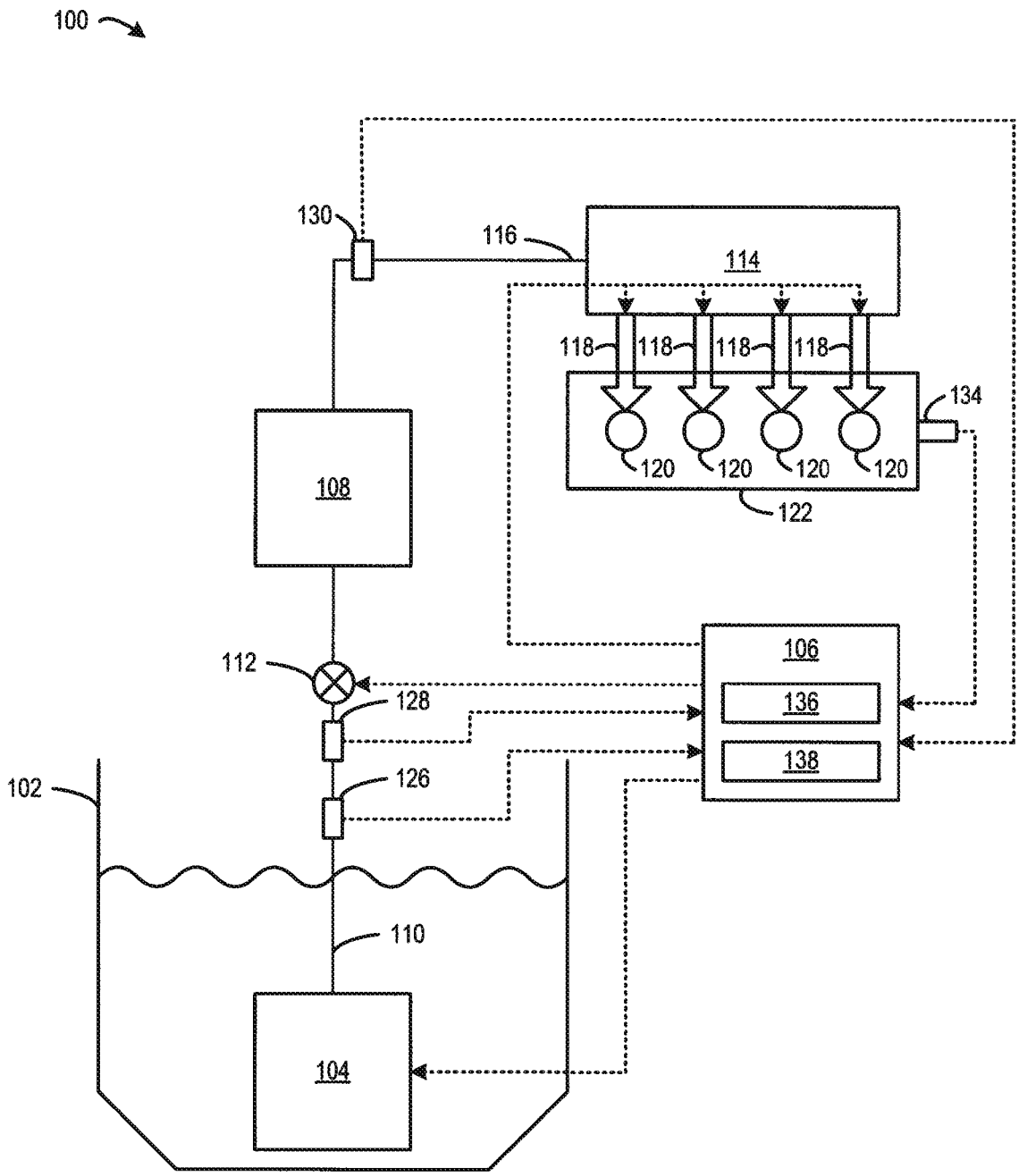
FIG. 1 schematically shows an example embodiment of a common rail fuel system of the present disclosure.
Figure 2:
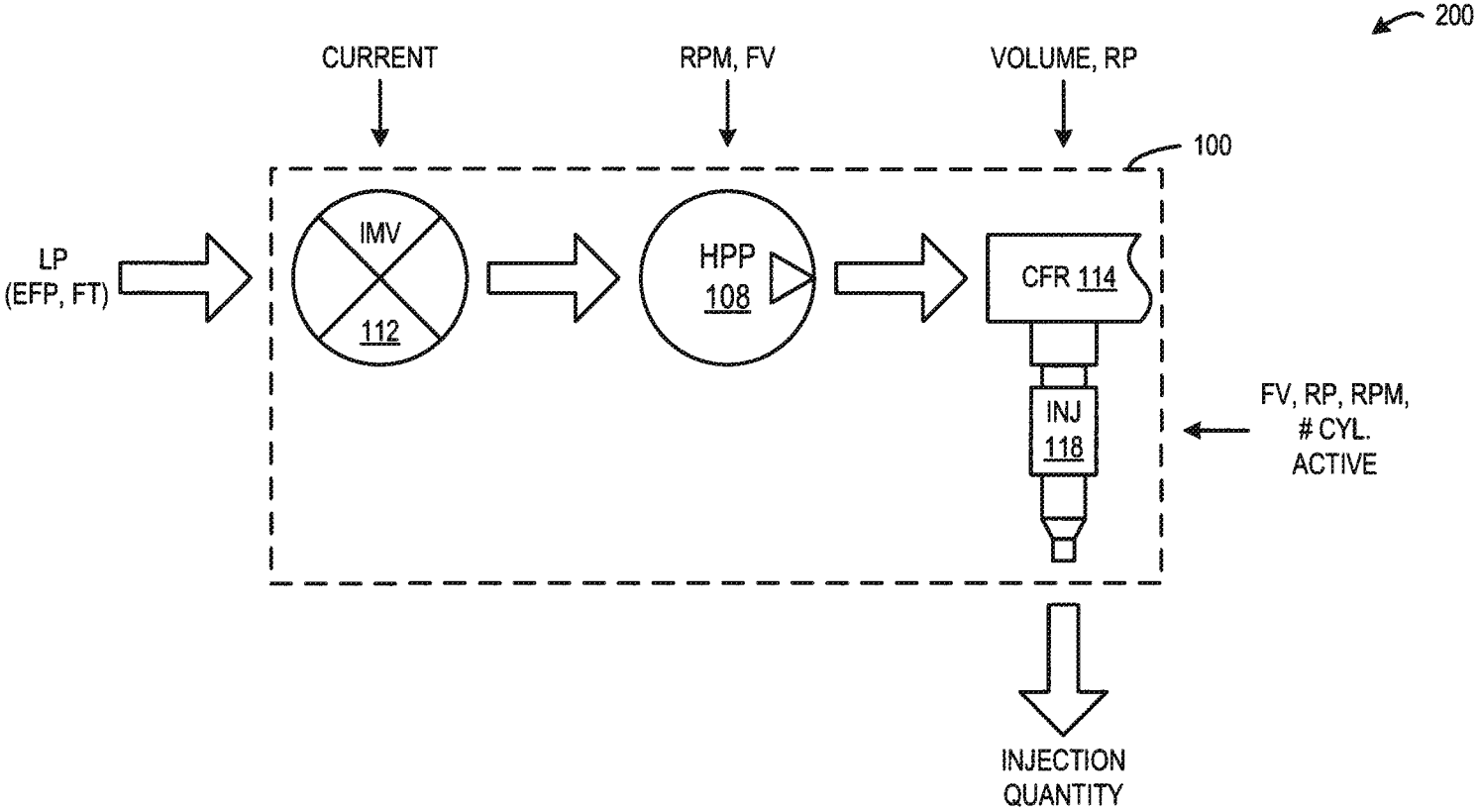
FIG. 2 schematically shows an example of a flow balance diagram of the common rail fuel system of FIG. 1.

A steady-state flow balance diagram representative of the CRS of FIG. 1 is shown in FIG. 2. The flow balance diagram represents a functional model that accounts for the effects of different operating parameters on the CRS and the flow of fuel into the system and out of the system. The flow balance, along with the IMV electrical current, may be used to identify a disparity between parameter values in the CRS. In one example, a flow balance function derived from the flow balance model provides a predicted electrical current of the IMV that represents the current that should result to provide an inlet metering valve position based on present operating conditions measured or determined through various sensors. The predicted current can then be compared with an actual IMV current indicative of an actual valve position to detect whether or not a leak exists or that a component of the CRS is degraded.

Figure 3:
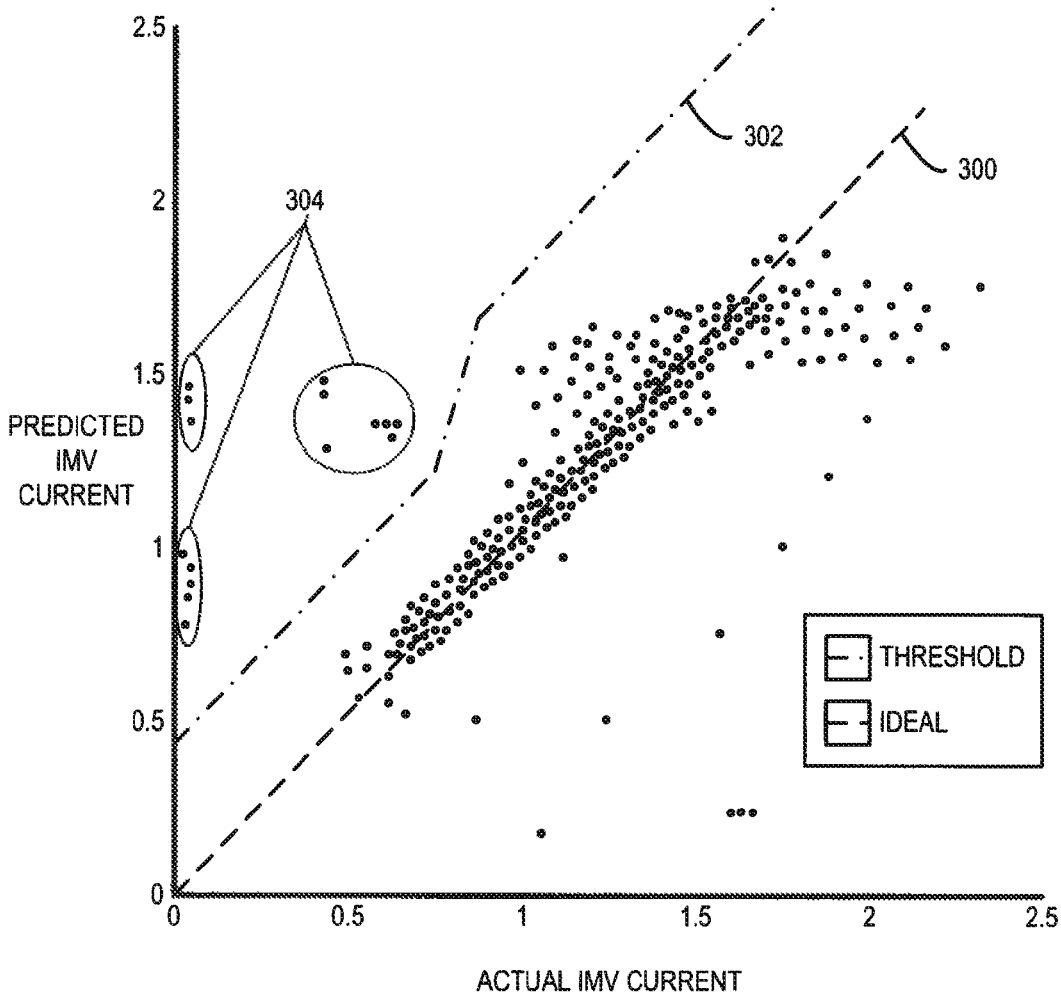
FIG. 3 shows a graph of a regression for prediction operation of the common rail fuel system of FIG. 1.
Figure 4:
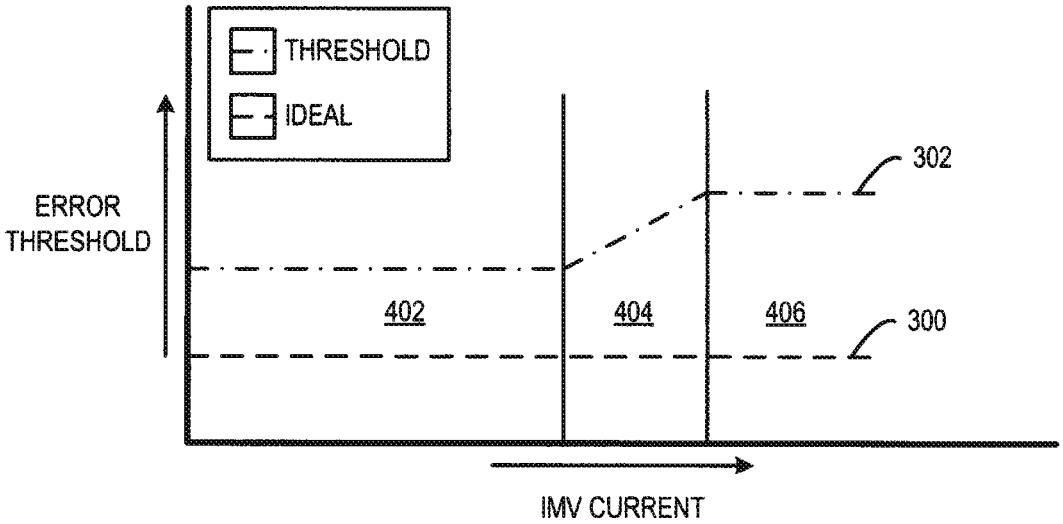
FIG. 4 shows a graph of a scalable error threshold that varies relative to an inlet meter valve current.
Figure 5:
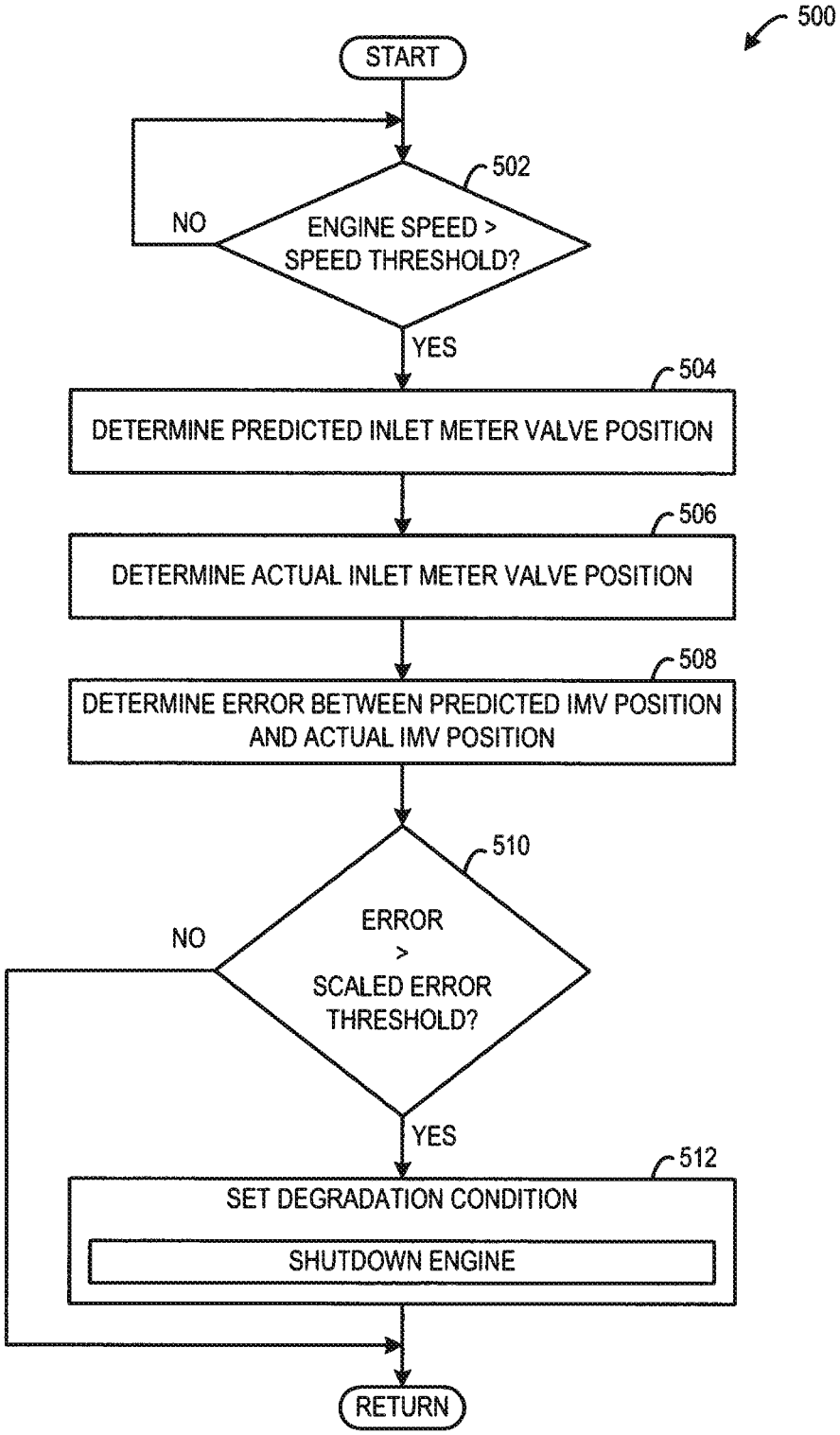
FIG. 5 is a flow diagram of an embodiment of a fuel leak detection method for controlling a common rail fuel system.

An example regression based on the flow balance function of FIG. 2 is shown in FIG. 3. An example error threshold between the predicted and actual IMV electrical current is shown in FIG. 4. An example method for controlling the CRS of FIG. 1 based on employing the flow balance function for the predicted IMV electrical current to detect a fuel leak is shown in FIG. 5. The method shown in FIG. 5 is performed to continually monitor for relatively large (e.g., gross) leaks in the CRS during engine operation (as compared to relatively small leaks).

Figure 6:
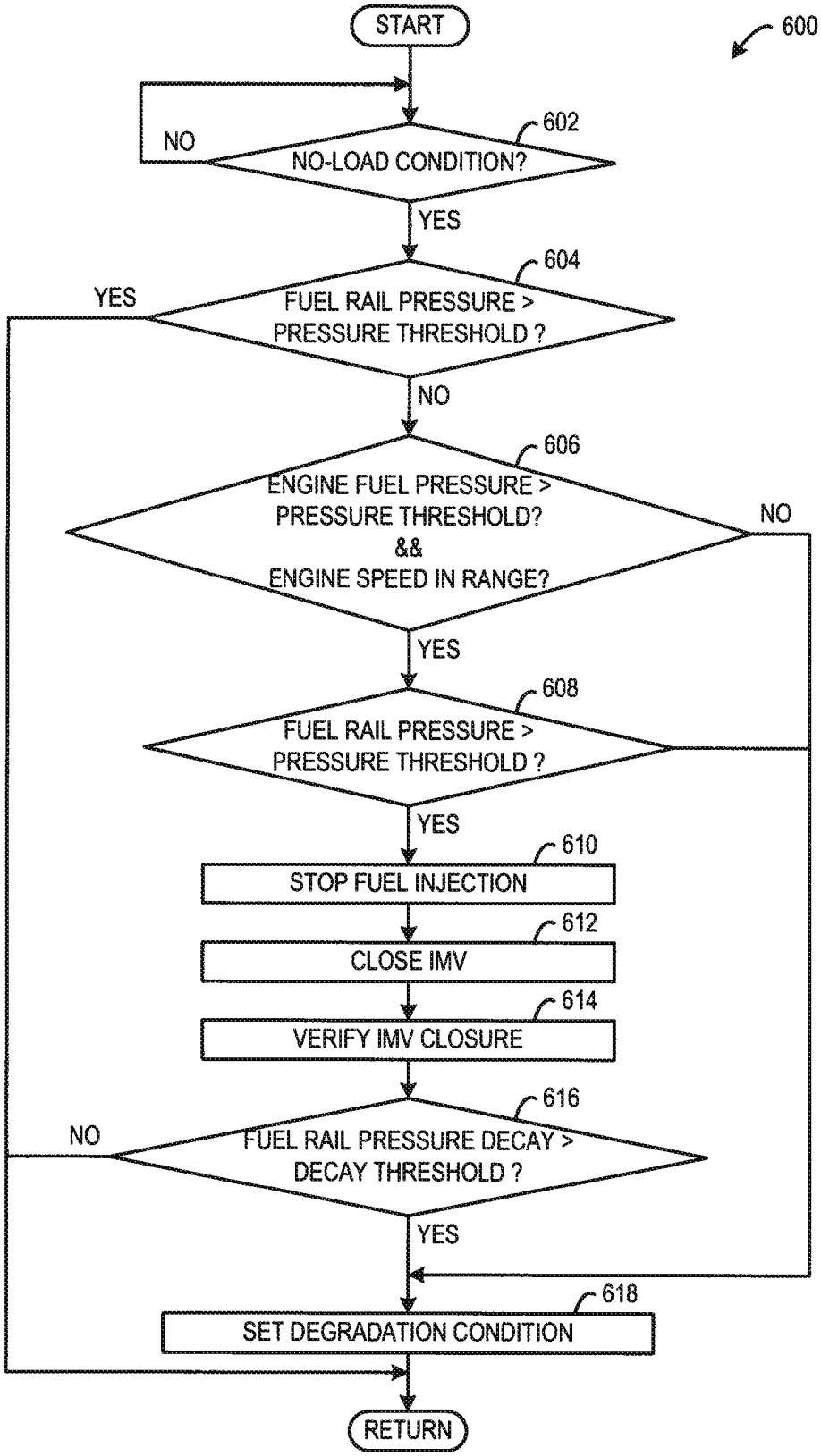
FIG. 6 is a flow diagram of an embodiment of a maintenance diagnostic method for controlling a common rail fuel system.

An example method for controlling the CRS of FIG. 1 based on monitoring a rate of fuel pressure decay to identify relatively small leaks (as compared to the relatively large leaks monitored by FIG. 5) is shown in FIG. 6. In particular, the method checks the integrity of the CRS by monitoring the rate of rail pressure decay during no-load conditions of the engine, such as at startup engine cranking events. In particular, during engine starting, a motor cranks the engine to initiate engine motion before fuel is delivered. During this condition, the engine is driven by the motor and is unloaded. Further, starting conditions can be particularly advantageous conditions during which to identify relatively small leaks, since such leaks are often caused by maintenance performed during shutdown conditions.

FIG. 1 includes a block diagram of a CRS 100 for an engine of a vehicle, such as a rail vehicle. In one example, the rail vehicle is a locomotive. In alternative embodiments, the engine may be in another type of off-highway vehicle, stationary power plant, marine vessel, or others. Liquid fuel is sourced or stored in a fuel tank 102. A low-pressure fuel pump 104 is in fluid communication with the fuel tank 102. In this embodiment, the low-pressure fuel pump 104 is disposed inside of the fuel tank 102 and can be immersed below the liquid fuel level. In alternative embodiments, the low-pressure fuel pump may be coupled to the outside of the fuel tank and pump fuel through a suction device. Operation of the low-pressure fuel pump 104 is regulated by a controller 106.

Liquid fuel is pumped by the low-pressure fuel pump 104 from the fuel tank 102 to a high-pressure fuel pump 108 through a conduit 110. A valve 112 is disposed in the conduit 110 and regulates fuel flow through the conduit 110. For example, the valve 112 is an inlet metering valve. The IMV 112 is disposed upstream of the high-pressure fuel pump 108 to adjust a flow rate of fuel that is provided to the high-pressure fuel pump 108 and further to a common fuel rail 114 for distribution to a plurality of fuel injectors 118 for fuel injection. For example, the IMV 112 may be a solenoid valve, opening and closing of which is regulated by the controller 106. In other words, the controller 106 commands the IMV to be fully closed, fully open, or a position in between fully closed and fully opened in order to control fuel flow to the high-pressure fuel pump 108 to a commanded fuel flow rate. During operation of the vehicle, the IMV 112 is adjusted to meter fuel based on operating conditions, and during at least some conditions may be at least partially open. It is to be understood that the valve is merely one example of a control device for metering fuel and any suitable control element may be employed without departing from the scope of this disclosure. For example, a position or state of the IMV may be electrically controlled by controlling an IMV electrical current. As another example, a position or state of the IMV may be mechanically controlled by controlling a servo motor that adjusts the IMV.

The high-pressure fuel pump 108 increases fuel pressure from a lower pressure to a higher pressure. The high-pressure fuel pump 108 is fluidly coupled with the common fuel rail 114. The high-pressure fuel pump 108 delivers fuel to the common fuel rail 114 through a conduit 116. A plurality of fuel injectors 118 are in fluid communication with the common fuel rail 114. Each of the plurality of fuel injectors 118 delivers fuel to one of a plurality of engine cylinders 120 in an engine 122. Fuel is combusted in the plurality of engine cylinders 120 to provide power to the vehicle through an alternator and traction motors, for example. Operation of the plurality of fuel injectors 118 is regulated by the controller 106. In the embodiment of FIG. 1, the engine 122 includes four fuel injectors and four engine cylinders. In alternate embodiments, more or fewer fuel injectors and engine cylinders can be included in the engine.

In some implementations, the common fuel rail is a single-walled fuel rail. The CRS also may include single-walled conduits (e.g., conduit 116 could be single-walled) for delivering fuel to the fuel rail. The single-walled configuration may be employed to reduce production costs as well as to reduce weight of the CRS, relative to a double-walled configuration.

Fuel pumped from the fuel tank 102 to an inlet of the IMV 112 by the low-pressure fuel pump 104 may operate at what is referred to as a lower fuel pressure or engine fuel pressure. Correspondingly, components of the CRS 100 which are upstream of the high-pressure fuel pump 108 operate in a lower fuel pressure or engine fuel pressure region. On the other hand, the high-pressure fuel pump 108 may pump fuel from the lower fuel pressure to a higher fuel pressure or rail fuel pressure. Correspondingly, components of the CRS 100 which are downstream of the high-pressure fuel pump 108 are in a higher-fuel pressure or rail fuel pressure region of the CRS 100.

A fuel pressure in the lower fuel pressure region is measured by a pressure sensor 126 that is positioned in the conduit 110. The pressure sensor 126 sends a pressure signal to the controller 106. In an alternative application, the pressure sensor 126 is in fluid communication with an outlet of the low-pressure fuel pump 104. A fuel temperature in the lower fuel pressure region is measured by a temperature sensor 128 that is positioned in conduit 110. The temperature sensor 128 sends a temperature signal to the controller 106.

A fuel pressure in the higher fuel pressure region is measured by a pressure sensor 130 that is positioned in the conduit 116. The pressure sensor 130 sends a pressure signal to the controller 106. In an alternative application, the pressure sensor 130 is in fluid communication with an outlet of the high-pressure fuel pump 108. Note that in some applications various operating parameters may be generally determined or derived indirectly in addition to or as opposed to being measured directly.

In addition to the sensors mentioned above, the controller 106 receives various signals from a plurality of engine sensors 134 coupled to the engine 122 that may be used for assessment of fuel control health and associated engine operation. For example, the controller 106 receives sensor signals indicative of air-fuel ratio, engine speed, engine load, engine temperature, ambient temperature, fuel value, a number of cylinders actively combusting fuel, etc. In the illustrated implementation, the controller 106 is a computing device, such as microcomputer that includes a processor unit 136, non-transitory computer-readable storage medium device 138, input/output ports, memory, and a data bus. Computer-readable storage medium 138 included in the controller 106 is programmable with computer readable data representing instructions executable by the processor for performing the control routines and methods described below as well as other variants that are not specifically listed.

The controller 106 is operable to adjust various actuators in the CRS 100 based on different operating parameters received or derived from different signals received from the various sensors, to dynamically assess the health of the CRS and control operation of the engine based on the assessment. For example, in an embodiment, the controller 106 is operable to perform a health check diagnostic that is performed continually to protect the engine during operation. The health check diagnostic leverages operational knowledge of the IMV to detect a gross fuel leak or other degradation. In particular, it is understood that the IMV is a normally open device during engine operation. Thus, it can be assumed that if the actual IMV position (or an electrical current indicative of position) is different from a predicted IMV position (or an electrical current indicative of position), then an excess flow of fuel is being provided to the common fuel rail. Furthermore, assuming that the fuel pressure downstream of the high-pressure pump and in the common fuel rail is regulated to a desired pressure (e.g., substantially constant), then it can be assumed that excess fuel flow is exiting the common fuel rail other than through commanded fuel injection. This excess fuel flow could represent either a leak in the CRS or another degradation of the CRS, such as an excessively worn high-pressure fuel pump.

The controller 106 is operable to perform the continuous health check diagnosis by determining a predicted IMV position that is based on a predicted IMV electrical current. The predicted IMV electrical current is derived from a flow balance function that will be discussed in further detail below with reference to FIG. 2. Further, the controller 106 is operable to determine an actual IMV position that is based on an actual IMV electrical current. For example, the actual IMV electrical current is provided by the controller 106 to the IMV 112 to control a valve position. The controller 106 is operable to determine an error between the predicted IMV electrical current and the actual IMV electrical current. If the error is greater than an error threshold, the controller 106 is operable to set a degradation condition. The error threshold may be set to any suitable value and may be calibrated to suit different CRS configurations. In some embodiments, the error threshold is scaled to vary as the IMV electrical current varies. Scaling of the error threshold will be discussed in further detail below with reference to FIG. 4.

In some implementations, the degradation condition may include shutting down the engine 122. By shutting down the engine in response to detection of a fuel leak, the likelihood of engine degradation, degraded operability, or the like may be reduced. In some implementations, the degradation condition may include setting a diagnostic flag and presenting an indication (e.g., visual or audio) of the degradation condition to an operator.

As another example of a dynamic health assessment of the CRS, the controller 106 is operable to check the integrity of the CRS for fuel leaks after maintenance periods of the CRS. Such an assessment checks for small leaks that are most likely to occur after improper maintenance so that they can be addressed before becoming bigger fuel leaks. The post-maintenance health assessment checks for small fuel leaks, whereas the above described health check diagnostic continually checks for gross fuel leaks. In particular, in regards to the former, the controller 106 is operable during a no-load condition of the engine, to stop fuel injection by the plurality of fuel injectors 118 and close the IMV 112. A no-load condition of the engine occurs when the engine is rotated by inertia or an external torque generated from outside of the engine. As one example, a no-load condition occurs during engine startup when a cranking motor turns the engine. The turning engine drives the fuel pumps to pressurize the common fuel rail. As another example, a no-load condition occurs when a motor/generator powers the engine. As yet another example, a no-load condition occurs when the engine absorbs torque or creates negative or brake torque, such as during a coast down event. A coast down event occurs when an engine is operating at speed and the demanded engine load becomes zero (or no-load) and the engine is rotated by inertia until external resistance slows the engine speed to a designated speed or the demanded engine load increases. Stated another way, a no-load condition of the engine is a condition where fuel injection is not necessary to meet an engine load. The post-maintenance assessment is performed during no-load conditions of the engine so that fuel injection can be stopped without interfering with engine operation.

Once fuel injection is stopped and the IMV is closed, the controller 106 monitors fuel pressure decay in the common fuel rail 114 for a first designated duration. The first duration may be designated or selected based on operating conditions, and may be a predetermined duration. If the fuel rail pressure decay rate of the fuel pressure in the common fuel rail is greater than a decay rate threshold after the first designated duration, the controller 106 is operable to set a degradation condition. If the fuel rail pressure decay rate is less than the decay rate threshold, fuel injection is restarted and engine operation continues. Fuel pressure decay refers to a drop or reduction in fuel pressure over time. Fuel pressure decay is monitored during the aforementioned control conditions (injection stopped and the IMV closed) because under such conditions, fuel should be neither significantly leaving nor entering the common fuel rail 114. Thus, a fuel pressure decay rate greater than the decay rate threshold is indicative of a possible leak condition.

In some implementations, the controller 106 is operable to verify closure of the IMV prior to initiating the first designated duration for measuring the fuel pressure decay rate of the common fuel rail 114 by starting the first designated duration in response to the IMV electrical current being greater than an electrical current threshold. In other words, the controller 106 waits for the electrical current to build to an electrical current threshold that indicates that the valve has fully closed before initiating monitoring of the fuel pressure decay.

In some implementations, as noted above, the degradation condition may include shutting down the engine 122. By shutting down the engine in response to detection of a fuel leak, the likelihood of engine degradation, degraded drivability, or the like may be reduced. In some implementations, the degradation condition may include setting a diagnostic flag and presenting an indication (e.g., visual or audio) of the degradation condition to an operator.

In some implementations, the controller 106 is operable to check that operating conditions are suitable prior to monitoring fuel pressure decay for determining possible fuel leaks. For example, the controller 106 is operable to check that the low-pressure fuel pump 104 is pumping fuel to the common fuel rail 114 so that there is enough fuel pressure built up to determine or measure fuel pressure decay. Correspondingly, the controller 106 is operable to check that the engine 122 is operating in a designated engine speed range where the engine is cranking to operate the fuel pump. By checking that such conditions are in effect, the likelihood of a false positive assessment of a fuel leak in the CRS may be reduced. Furthermore, the controller 106 is operable to set a degradation condition if the fuel rail pressure is less than a rail fuel pressure threshold for a second designated duration when such conditions are in effect (e.g., the engine fuel pressure at an inlet of the IMV is greater than an engine fuel pressure threshold and an engine speed is in a designated engine speed range). The second designated duration may be the same or different from the first designated duration for monitoring fuel pressure decay. In one example, the first designated duration is 0.2 seconds and the second designated duration is 30 seconds. In other words, if the engine 122 is cranking and the low-pressure fuel pump 104 is pumping fuel, but the fuel pressure is not building beyond the fuel pressure threshold after the second designated duration, then it is assumed that a fuel leak exists or a component of the CRS is degraded.

In some implementations, the non-transitory electronically-readable medium 138 has one or more sets of instructions stored thereon that when accessed and executed by an electronic device (e.g., processor unit 136) cause the electronic device to: during a no-load condition of an engine, generate one or more first signals for controlling stopping fuel injection by the plurality of fuel injectors 118 of the engine 122, generate one or more second signals for controlling closing the valve 112 that is operable to control fuel flow to the fuel pump 108. The fuel pump 108 is coupled with a common fuel rail 114 of the engine 122 for providing fuel to the common fuel rail 118. Furthermore, the instructions that when accessed and executed by the electronic device cause the electronic device to: generate one or more third signals, for controlling operation of the engine, in response to a decay rate of a fuel pressure in the common fuel rail 114 being greater than a decay threshold after the first designated duration. For example, the one or more third signals cause the engine 122 to be shut down in response to the decay rate of the fuel pressure in the common fuel rail being greater than the decay rate threshold.

FIG. 2 schematically shows an example of a flow balance diagram 200 of the CRS 100 of FIG. 1. The flow balance diagram 200 applies conservation of mass to analyze the flow of fuel in and out of the CRS 100. In particular, by accounting for fuel entering and leaving the CRS, discrepancies in fuel flow can be identified that otherwise may be difficult to accurately measure.

The fuel flow input to the flow balance diagram 200 is determined based on an amount of fuel provided from the lower pressure (LP) region of the CRS 100. In particular the fuel flow input is based on an engine fuel pressure (EFF) provided by operation of the low-pressure fuel pump 104 and a fuel temperature (FT) of fuel in the lower pressure region. The engine fuel pressure and the fuel temperature are used to determine the fuel flow input to the flow balance diagram 200. The engine fuel pressure is provided to the controller 106 by the pressure sensor 126. The fuel temperature is provided to the controller 106 by the temperature sensor 128. On the other hand, the fuel flow output of the flow balance diagram 200 is based on an injection quantity of fuel injected by active fuel injectors. For example, the fuel injection quantity can be determined from commanded fuel injection through a pulse width modulation signal. Note that active fuel injectors refer to fuel injectors in which fuel is injected for combustion in a cylinder during an engine cycle (which may be 2 or 4 strokes, for example).

The flow balance diagram 200 includes components that affect the balance of fuel flow in and out of the CRS 100. The flow balance diagram 200 includes the IMV 112, the high-pressure fuel pump (HPP) 108, the common fuel rail 114, and the plurality of fuel injectors 118. Each of these components affects fuel flow balance differently based on a state of operation that is indicated by different operating parameters that are specific to that component.

For example, an operating state of the IMV 112 is indicated by an IMV electrical current. The IMV current is provided by the controller 106 to the IMV 112 via a control line to control the position of the IMV. As one example, a higher IMV current indicates an IMV position is more closed (maximum IMV current indicates a fully closed position) and a lower IMV current indicates the IMV position is more open (zero or minimum IMV current indicates a fully open position). The IMV current in conjunction with the input fuel flow can be used to determine an amount of fuel flow provided to the high-pressure fuel pump 108.

An operating state of the high-pressure fuel pump 108 is determined from the engine speed (e.g., revolutions per minute (RPM)) and a fuel value (FV). The engine speed is provided to the controller 106 by one of the plurality of engine sensors 134. In implementations where the high-pressure fuel pump 108 is engine driven, the fuel pump operation increases as the engine speed increases. The fuel value is an amount of fuel that is pumped by the high-pressure fuel pump 108 with each pump stroke. The engine speed and the fuel value determine the rate of fuel flow provided to the common fuel rail 114.

An operating state of the common fuel rail 114 is indicated by a volume or fuel capacity of the common fuel rail and a rail pressure (RP) of fuel in the common fuel rail. The rail pressure is provided to the controller by the pressure sensor 130. The volume and the rail pressure are used to determine an amount of fuel that is stored in the common fuel rail 114.

An operating state of the plurality of fuel injectors 118 is indicated by a fuel value (FV) that is an amount of fuel injected by each fuel injection stroke, the rail pressure of fuel in the common fuel rail, the engine speed (RPM), and a total number of active cylinders in which fuel is injected.

A function for predicting the IMV current during engine operation is derived from the operating parameters that affect the state of operation of the components of the CRS as demonstrated in the flow balance diagram 200. One example of the function for predicting IMV current based on the flow balance diagram 200 is:

$$\text{IMC CURRENT}=f\{A+(B^*\text{EFP})+(C^*\text{FV}^*\text{RPM}^*\text{EFP}^*(\text{ACTIVE/TOTAL}))\}$$

where A, B, and C are variables that are calibratable according to the configuration of the CRS where EFP is the engine fuel pressure of fuel provided by the low-pressure fuel pump at the inlet of the IMV where FV is the fuel value of a quantity of fuel injected by a single injector stroke (also referred to as a fuel charge)

where RPM is the engine speed in revolutions per minute where ACTIVE is the number of engine cylinders in which fuel is being injected by a fuel injector where TOTAL is the total number of engine cylinder in the engine the above function produces a mapping between a total fuel amount and a IMV position with more fuel corresponding to a lower electrical current (more open valve) and less fuel to a higher electrical current (more closed valve)

In some implementations, the FV term can be replaced by a gross horsepower (GHP) term or another term that is a strong function of FV. As one example, the function for predicting IMV electrical current that is commanded to be sent to the IMV during engine operation is generated from a regression. The regression is created using approximately 5000 random data points from various CRS units and verified against 30,000 data points from those CRS units.

FIG. 3 shows a graph of the regression for predicting the IMV electrical current as applied to a data set. It should be understood that the graph is non-limiting and merely provided as an example and other data points are possible. The graph compares an actual IMV electrical current (x-axis) to a predicted IMV electrical current (y-axis) produced by the above described function. In the graph, data points from the data set are shown relative to an ideal regression line or an ideal error line 300 (shown as a dashed line) where the predicted IMV electrical current matches the actual IMV electrical current. Furthermore, an error threshold line 302 (shown as a dot-dashed line) is located above the ideal error line. Data points that are below the error threshold line 302 are representative of a fuel flow that is considered within acceptable operating conditions of the CRS 100. In other words, the fuel flow entering the CRS is substantially balanced with fuel flow exiting the CRS. On the other hand, if the actual IMV electrical current is significantly below the predicted IMV electrical current such that the data points are above the error threshold line 302, as is the case with data points 304, it can be assumed a condition exists where excess fuel is flowing into the system relative to fuel output from the system. Such a condition is indicative of a fuel leak or another degradation of the CRS.

In some implementations, the error threshold varies in scale relative to the ideal error over a range of the IMV electrical current. In some implementations, the error threshold increases relative to the ideal error as the IMV electrical current increases over a range of IMV electrical current. In some implementations, the error threshold is scaled nonlinearly relative to the ideal error. In some implementations, the error threshold varies differently relative to the ideal IMV error in different regions of the IMV electrical current.

FIG. 4 shows one example of how the error threshold varies relative to the ideal error in different regions of IMV electrical current. In a first region 402 where the predicted IMV electrical current is lower, the error threshold is set to a first value. In a second region 406 where the predicted IMV electrical current is greater than the predicted IMV electrical current of the first region 402, the error threshold is set to a second value that is greater than the first value. The second region 406 is an upper region of predicted IMV electrical current during engine operation. In a third region 404 between the first region 402 and the second region 406 the error threshold is a ramp function between the first value and the second value. In other words, in the third region 404, the error threshold increases at a constant ramp value from the first value to the second value. A shape of the error threshold 302 is defined to accommodate for a larger variance in data points of the regression as the IMV electrical current increases. By varying the error threshold relative to the ideal error based on a region of predicted IMV electrical current, engine shutdowns due to false positive determinations of a fuel leak (a.k.a. nuisance faults) are reduced. Accordingly, engine operation is disrupted less often. It will be appreciated that the shape of the error threshold may be changed to virtually any suitable shape to accommodate variance in the data points of the regression without departing from the scope of this disclosure.

FIG. 5 is a flow diagram of an embodiment of a fuel leak detection method 500 for controlling a common rail fuel system. In one example, the method 500 is executable by the controller 106 shown in FIG. 1. In particular, the controller 106 executes the method 500 repeatedly throughout engine operation to monitor for gross fuel leaks in the CRS 100. At 502, the method 500 includes determining if an engine speed is greater than a speed threshold. The determination step checks to see if the engine is operating at a suitable engine speed to operate the engine driven fuel pumps so that fuel flows through the IMV 112 and injected by the plurality of fuel injectors 118. The speed threshold may be set to virtually any suitable speed. In one example, the speed threshold is set to 330 RPM. The determination step may be performed for a predetermined duration. In one example, the predetermined duration is 5 seconds. If it is determined that the engine speed is greater than the speed threshold, the method 500 moves to 504. Otherwise, the method returns to 502.

At 504, the method 500 includes determining a predicted inlet metering valve position. In some implementations, the predicted IMV position is based on a predicted IMV electrical current. In one example, the predicted inlet metering valve electrical current is a function of a fuel pressure at an inlet of the inlet metering valve, a quantity of fuel injected by a single fuel injector stroke of a fuel injector coupled to the common fuel rail, an engine speed, and a number of active engine cylinders. In another example, the predicted inlet metering valve electrical current is a function of a fuel pressure at an inlet of the inlet metering valve, a horse power of the engine (e.g., gross or net horsepower), an engine speed, and a number of active engine cylinders. Either of the example functions can be generated from a regression of IMV electrical current from data points generated from operation of the CRS 100. Additionally or alternatively, a flow rate of fuel through the IMV may be predicted.

At 506, the method 500 includes determining an actual inlet metering valve position. In some implementations, the actual IMV position is based on an actual IMV electrical current. In one example, the controller 106 provides the actual IMV electrical current to the IMV 112 through a control line. Additionally or alternatively, a flow rate of fuel through the IMV may be measured, determined, or derived from other operating parameters.

At 508, the method 500 includes determining an error between the predicted inlet metering valve position (or IMV electrical current) and the actual inlet metering valve position (or IMV electrical current). In one example, the error is determined by taking the difference of the actual IMV electrical current and the predicted IMV electrical current. In some implementations, samples of the actual and predicted IMV electrical current are taken over a duration and an average of the difference is filtered to determine the error. Additionally or alternatively, an error between a predicted flow rate and an actual flow rate of fuel through the IMV may be determined.

At 510, the method 500 includes determining if the error is greater than an error threshold. If the error is greater than the error threshold, the method 500 moves to 512. Otherwise, the IMV electrical current is within a suitable operating range and fuel flow in and out of the CRS is appropriate, and the method 500 returns to other operations.

At 512, the method 500 includes setting a degradation condition in response to the error being greater than the error threshold. The error threshold may be set to any suitable value. In some implementations, the error threshold may be set to a small number or approximately zero. In such implementations, the method would include setting the degradation condition in response to the error. In some implementations, setting the degradation condition includes shutting down the engine (e.g., automatically). In some implementations, setting the degradation condition includes providing an indication of a fuel leak to an operator. As one example, a fuel leak indicator light is turned on in response to the degradation condition being set.

By using the inlet metering valve electrical current to predict operation of the common rail fuel system, fuel leaks are detected merely using standard engine operating parameters without specialized sensors or additional inputs. Such an approach may reduce production costs and design complexity of the common rail fuel system. In other words, such a method provides "non-invasive" CRS leak detection that can be continually performed to protect the engine throughout operation.

FIG. 6 is a flow diagram of an embodiment of a maintenance diagnostic method 600 for controlling a common rail fuel system. In one example, the method 600 is executable by the controller 106 shown in FIG. 1. At 602, the method 600 includes determining if there is currently a no-load condition of the engine. A no-load condition of the engine occurs when the engine is rotated by inertia or an external torque generated from outside of the engine. As one example, a no-load condition occurs during engine startup when a cranking motor turns the engine. The turning engine drives the fuel pumps to pressurize the common fuel rail. As another example, a no-load condition occurs when a motor/generator powers the engine. As yet another example, a no-load condition occurs when the engine absorbs torque or creates negative or brake torque, such as during a coast down event. Stated another way, a no-load condition of the engine is a condition where fuel injection is not necessary to meet an engine load. If a no-load condition exists, the method 600 moves to 604. Otherwise, the method 600 returns to 602.

At 604, the method 600 includes determining if a fuel rail pressure is greater than a rail pressure threshold. The determination step checks to see if the fuel rail pressure is already built up to a sufficient level for operation. The rail pressure threshold may be set to any suitable pressure level. In one example, the rail pressure threshold is set to 40,000 kPa. If the fuel rail pressure is greater than the rail pressure threshold, the method 600 returns to other operations. Otherwise, the method 600 moves to 606.

At 606, the method 600 includes determining if the fuel rail pressure becomes greater than the rail pressure threshold for a second designated duration while an engine fuel pressure is greater than an engine pressure threshold and an engine speed is in a designated engine speed range. The engine fuel pressure represents the pressure of fuel provided by the low-pressure fuel pump at the inlet of the IMV. The engine speed range determination checks to see if the engine is actually cranking to drive the low-pressure fuel pump. The engine fuel pressure determination checks to see if fuel is actually being provided to the IMV to build pressure in the common fuel rail. If the engine is cranking and the engine fuel pressure is less than the engine pressure threshold, then it can be assumed that there is an insufficient engine fuel pressure to operate the engine and the low-pressure fuel pump may or may not be functioning properly. Accordingly, the method 600 moves to 618. If the engine is cranking and the engine fuel pressure is building pressure beyond the threshold the method 600 moves to 608.

At 608, the method 600 includes determining if the fuel rail pressure is greater than the rail pressure threshold. If the engine is cranking (e.g., engine speed in speed range) and the low-pressure fuel pump is pumping fuel (e.g., engine fuel pressure>engine pressure threshold), but the fuel rail is not pressurizing (e.g., the fuel rail pressure<rail pressure threshold), then it can be assumed that there is a leak in the high pressure fuel system or another type of degradation and the method 600 moves to 618. Otherwise, if the engine is cranking, the low-pressure fuel pump is operating, and the fuel rail pressure is built up to a sufficient pressure level to test for fuel pressure decay, then the method 600 moves to 610.

The second designated duration, the engine fuel pressure threshold, and the engine speed range may be set to any suitable values. In one example, the second designated duration is 30 seconds, the rail fuel pressure threshold is 40,000 kPa, the engine fuel pressure threshold is approximately 241 kPa and the designated engine speed range is between 35 and 325 RPM. If the fuel rail pressure remains greater than the rail pressure threshold for during these operating conditions, the method 600 moves to 610. Otherwise, it can be assumed that there is degradation of the CRS, such as a gross fuel leak, since fuel rail pressure is unable to remain above the rail pressure threshold. If the fuel pressure becomes less than the rail fuel pressure threshold for the selected duration, the method moves to 618.

At 610, the method 600 includes stopping fuel injection by the plurality of fuel injectors. In one example, stopping fuel injection includes controlling a pulse width modulation signal to command the plurality of fuel injectors to not inject fuel. In some implementations, stopping fuel injection includes turning off a fuel pump that provides fuel to an inlet of the inlet metering valve. Moreover, the fuel injection may be stopped in any suitable way including preventing fuel from entering a high-pressure fuel pump that supplies fuel to the fuel rail, such as by closing an additional cut-off valve or the like.

At 612, the method 600 includes closing the IMV. In one example, closing the IMV includes commanding an IMV electrical current for controlling a position of the IMV to be increased to an electrical current that corresponds to a fully closed position.

At 614, the method 600 includes verifying closure of the IMV prior to initiating a predetermined duration for measuring a fuel pressure decay rate of the common fuel rail. In one example, verifying closure of the IMV includes starting the first designated duration in response to the IMV electrical current being greater than an electrical current threshold. The electrical current threshold is set to an electrical current that corresponds to the fully closed position of the IMV. In one example, the electrical current threshold is set to 1.8 Amps. By verifying closure of the IMV, a determination accuracy of the fuel pressure decay rate may be increased.

At 616, the method 600 includes determining if a fuel rail pressure decay rate of a fuel pressure in the common fuel rail is greater than a decay threshold after a first designated duration. The pressure decay rate and the first designated duration may be set to any suitable value. In one example, the decay threshold is 500 kPa and the first designated duration is 0.2 seconds. If the fuel rail pressure decay rate is greater than the decay threshold, the method 600 moves to 618. Otherwise, it is determined that a fuel leak does not exist and the method 600 returns to other operations.

At 618, the method 600 includes setting a degradation condition. In some cases, the degradation condition is set in response to the fuel rail pressure decay rate of the fuel pressure in the common fuel rail being greater than the decay threshold after the first designated duration. In such cases, the degradation condition indicates that a fuel leak exists in the higher-pressure region of the CRS between the IMV and the fuel injectors. In some cases, the degradation condition is set in response to the fuel pressure being less than the fuel rail pressure threshold for the second designated duration where the engine fuel pressure is greater than the engine fuel pressure threshold and the engine speed in a designated engine speed range. In such cases, the degradation condition indicates that a gross fuel leak exists in the CRS or a component has degraded, since fuel pressure cannot build up in the common fuel rail even though fuel is being pumped by the low-pressure fuel pump.

In some implementations, setting the degradation condition includes shutting down the engine. In some implementations, setting the degradation condition includes providing an indication of a fuel leak to an operator. As one example, a fuel leak indicator light is turned on in response to the degradation condition being set.

The above described method enables the detection of fuel leaks in the CRS with high resolution. More particularly, by monitoring the fuel pressure decay rate in the common fuel rail, relatively small leaks (or very slow dripping leaks) across all components and connections in the CRS can be detected. Moreover, by performing the method during no-load conditions, leak detection can be performed without disrupting engine operation. Accordingly, a decrease in drivability or operation may be inhibited. More particularly, when the method is performed during a startup event, leak detection is performed in those times when the CRS is most suspect to fuel leaks due to improper maintenance. Accordingly, fuel leaks may be detected early before they become bigger or cause greater degradation to the CRS.

Furthermore, the method enables detection of fuel leaks in a double-walled system where a liquid sensor would not. For example, the method detects fuel leaks that occur through an injector nozzle, an injector control path, etc. Moreover, the method does not require additional sensors or input/output combinations. The method may be applicable to engine configurations that include a large number of fuel injectors where fuel injection events occur more frequently and the period between fuel injection events is too short to monitor the fuel pressure decay rate for fuel leaks.

Another embodiment relates to a fuel system for an engine. The system includes a fuel pump, and a valve operable to control fuel flow to the fuel pump. The fuel system also includes a common fuel rail fluidly coupling the fuel pump to a plurality of fuel injectors operable to inject fuel to cylinders of the engine. The fuel system also includes a controller operable to receive information of a predicted valve position of the valve, and/or calculate the predicted valve position. The controller is further operable to receive information of an actual valve position of the valve, and/or determine the actual valve position. The controller is further operable to calculate an error between the predicted valve position and the actual valve position, and to generate one or more signals relating to setting a degradation condition, in response to the error.

Another embodiment relates to a fuel delivery system. The system comprises a fuel pump, a valve that is operable to control fuel flow to the fuel pump, and a common fuel rail fluidly coupling the fuel pump to a plurality of fuel injectors operable to inject fuel to cylinders of an engine. The system further comprises a controller. The controller is operable to, during a no-load condition of the engine: stop fuel injection by the plurality of fuel injectors (e.g., all the injectors of the engine); close the valve; and set a degradation condition in response to a decay rate of a fuel pressure in the common fuel rail being greater than a decay threshold after a duration (e.g., a selected or otherwise designated duration). Such a system could be implemented in the context of an engine having a single, high-pressure fuel pump.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. In the appended claims, any instances of the terms "including"/"includes" or "having"/"has" are used as the plain-language equivalents of the respective terms "comprising"/"comprises", and "in which" is used as the plain-language equivalent of "wherein." Moreover, in the following claims, the terms "first," "second," and "third," etc. are used merely as labels, and are not intended to impose numerical or spatial requirements on their objects.

The foregoing description of certain embodiments of the present invention will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

The invention claimed is:

1. A method for controlling a system having an engine, the method comprising:

determining a predicted valve position of a valve, the valve being operable to control fuel flow to a fuel pump that pumps fuel to a common fuel rail of the engine, the predicted valve position based on a predicted valve electrical current that is a function of a fuel pressure at an inlet of the valve, an operating state of a plurality of fuel injectors of the engine, an engine speed, and a number of active engine cylinders;

determining an actual valve position based on an actual valve electrical current;

determining an error between the predicted valve position and the actual valve position; and setting a degradation condition in response to the error.

2. The method of claim 1, wherein setting the degradation condition includes shutting down the engine.

3. The method of claim 1, wherein the operating state of the plurality of fuel injectors of the engine comprises a quantity of fuel injected by a single fuel injector stroke of a fuel injector of the plurality of fuel injectors coupled to the common fuel rail.

4. The method of claim 1, wherein the operating state of the plurality of fuel injectors of the engine comprises a horse power of the engine.

5. The method of claim 1, wherein the degradation condition is set in response to the error being greater than an error threshold.

6. The method of claim 5, wherein the error threshold increases relative to an ideal error as the predicted valve electrical current increases.

7. The method of claim 6, wherein the error threshold is scaled nonlinearly relative to the ideal error.

8. The method of claim 5, wherein for a first region of the predicted valve electrical current the error threshold is a first value, for a second region where the predicted valve electrical current is greater than the predicted valve electrical current of the first region the error threshold is a second value that is greater than the first value, and for a third region of the predicted valve electrical current between the first region and the second region the error threshold is a ramp function between the first value and the second value.

9. A system comprising:

a low-pressure fuel pump operable to pump fuel from a fuel source at a first pressure;

a high-pressure fuel pump operable to increase the first pressure to a second pressure;

a valve positioned between the low-pressure fuel pump and the high-pressure fuel pump, the valve being operable to control fuel flow to the high-pressure fuel pump;

a common fuel rail fluidly coupling the high-pressure fuel pump to a plurality of fuel injectors that is operable to inject fuel to cylinders of an engine; and a controller operable to determine a predicted valve position of the valve, the predicted valve position a function of a fuel pressure at an inlet of the valve, a quantity of fuel injected by a single fuel injector stroke of a fuel injector coupled to the common fuel rail, an engine speed, and a number of active engine cylinders, determine an actual valve position of the valve, calculate an error between the predicted valve position and the actual valve position, and set a degradation condition in response to the error.

10. The system of claim 9, wherein the controller is operable to shut down the engine in response to the degradation condition being set.

11. The system of claim 9, wherein the degradation condition is set in response to the error being greater than an error threshold.

12. The system of claim 11, wherein the predicted valve position includes a predicted valve electrical current and the actual valve position includes an actual valve electrical current.

13. The system of claim 12, wherein for a first region of the predicted valve electrical current the error threshold is a first value, for a second region where the predicted valve electrical current is greater than the predicted valve electrical current of the first region the error threshold is a second value that is greater than the first value, and for a third region of the predicted valve electrical current between the first region and the second region the error threshold is a ramp function between the first value and the second value.

14. A system comprising:

a low-pressure fuel pump operable to pump fuel from a fuel source at a first pressure;

a high-pressure fuel pump operable to increase the first pressure to a second pressure;

a valve positioned between the low-pressure fuel pump and the high-pressure fuel pump, the valve being operable to control fuel flow to the high-pressure fuel pump;

a common fuel rail fluidly coupling the high-pressure fuel pump to a plurality of fuel injectors that is operable to inject fuel to cylinders of an engine; and a controller operable to determine a predicted valve electrical current of the valve that is a function of a fuel pressure at an inlet of the valve, a quantity of fuel injected by a single fuel injector stroke of one of the plurality of fuel injectors, an engine speed, and a number of active engine cylinders, determine an actual valve electrical current of the valve, determine an error between the predicted valve electrical current and the actual valve electrical current, and shut down the engine in response to the error being greater than an error threshold.

15. The system of claim 14, wherein the error threshold varies in scale relative to an ideal error over a range of the predicted valve electrical current.

16. The system of claim 15, wherein the error threshold increases relative to the ideal error as the predicted valve electrical current increases.

17. The system of claim 16, wherein the error threshold is scaled nonlinearly relative to the ideal error.

18. The system of claim 14, wherein for a first region of the predicted valve electrical current the error threshold is a first value, for a second region where the predicted valve electrical current is greater than the predicted valve electrical current of the first region the error threshold is a second value that is greater than the first value, and for a third region of the predicted valve electrical current between the first region and the second region the error threshold is a ramp function between the first value and the second value.

19. The system of claim 14, wherein the common fuel rail is a single-walled common fuel rail.

20. A non-transitory electronically-readable medium having one or more sets of instructions stored thereon that when accessed and executed by an electronic device cause the electronic device to:

at least one of: receive information of a predicted valve position of a valve; or calculate the predicted valve position, the valve operable to control fuel flow to a fuel pump configured to pump fuel to a common fuel rail of an engine, the predicted valve position a function of a fuel pressure at an inlet of the valve, a quantity of fuel injected by a single fuel injector stroke of one of the plurality of fuel injectors, an engine speed, and a number of active engine cylinders;

at least one of: receive information of an actual valve position of the valve; or determine the actual valve position;

calculate an error between the predicted valve position and the actual valve position; and generate one or more signals relating to setting a degradation condition in response to the error.

* * * * *